US010954785B2

(12) United States Patent
Sollami

(10) Patent No.: US 10,954,785 B2
(45) Date of Patent: Mar. 23, 2021

(54) BIT HOLDER WITH ENLARGED TIRE PORTION AND NARROWED BIT HOLDER BLOCK

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 16/570,441

(22) Filed: Sep. 13, 2019

(65) Prior Publication Data

US 2020/0003055 A1 Jan. 2, 2020

Related U.S. Application Data

(63) Continuation of application No. 15/062,620, filed on Mar. 7, 2016, now Pat. No. 10,633,971.

(51) Int. Cl.
*E21C 35/19* (2006.01)

(52) U.S. Cl.
CPC ..... *E21C 35/19* (2013.01)

(58) Field of Classification Search
CPC ..... E21C 35/18; E21C 35/19; E21C 35/191; E21C 2035/01826; E21C 2035/1826
See application file for complete search history.

(56) References Cited

U.S. PATENT DOCUMENTS

| | | | |
|---|---|---|---|
| 2,382,947 | A | 7/1944 | Brozek |
| 2,810,567 | A | 10/1957 | Kirkham |
| 3,342,531 | A | 9/1967 | Krekeler |
| 3,342,532 | A | 9/1967 | Krekeler |
| 3,397,012 | A | 8/1968 | Krekeler |
| 3,476,438 | A | 11/1969 | Bower, Jr. |
| 3,519,309 | A | 7/1970 | Engle |
| 3,833,264 | A | 9/1974 | Elders |
| 3,833,265 | A | 9/1974 | Elders |
| 3,865,437 | A | 2/1975 | Crosby |
| 4,084,856 | A | 4/1978 | Emmerich |
| 4,247,150 | A | 1/1981 | Wrulich et al. |
| RE30,807 | E | 12/1981 | Elders |
| 4,310,939 | A | 1/1982 | Iijima |
| 4,453,775 | A | 6/1984 | Clemmow |
| 4,478,298 | A | 10/1984 | Hake |
| 4,489,986 | A | 12/1984 | Dziak |
| 4,525,178 | A | 6/1985 | Hall |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Janine M Kreck

(74) *Attorney, Agent, or Firm* — Rockman Videbeck & O'Connor; Mercedes V. O'Connor

(57) ABSTRACT

A bit assembly includes a base block and a bit holder having a forward body portion and a shank. The forward body portion includes an enlarged tire portion to deflect material and particles removed from the terra firma and protect the base block from damage. The base block includes a base and a shortened front end. The enlarged tire portion has dimensions that cover at least all of the shortened from end. The dimensions of the tire portion can also extend beyond the dimensions of the shortened front end.

7 Claims, 18 Drawing Sheets

(56) References Cited

U.S. PATENT DOCUMENTS 4,561,698 A 12/1985 Beebe
4,570,726 A 2/1986 Hall
4,604,106 A 8/1986 Hall
4,632,463 A * 12/1986 Sterwerf, Jr. ..... E21C 35/197 299/104
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 * 2/2004 Sollami ..... B28D 1/188 299/102
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,537,288 B2 * 5/2009 Chiang ..... B28D 1/188 299/102
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall
8,007,049 B2 8/2011 Fader et al.
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
8,740,314 B2 6/2014 O'Neill
9,004,610 B2 4/2015 Erdmann et al.
9,028,008 B1 5/2015 Bookhamer

(56) References Cited

U.S. PATENT DOCUMENTS

| | | | |
|---|---|---|---|
| 9,039,099 | B2 | 5/2015 | Sollami |
| 9,316,061 | B2 | 4/2016 | Hall |
| 9,518,464 | B2 | 12/2016 | Sollami |
| 9,879,531 | B2 | 1/2018 | Sollami |
| 9,909,416 | B1 | 3/2018 | Sollami |
| 9,976,418 | B2 | 5/2018 | Sollami |
| 9,988,903 | B2 | 6/2018 | Sollami |
| 10,072,501 | B2 | 9/2018 | Sollami |
| 10,105,870 | B1 | 10/2018 | Sollami |
| 10,107,097 | B1 | 10/2018 | Sollami |
| 10,107,098 | B2 | 10/2018 | Sollami |
| 10,180,065 | B1 | 1/2019 | Sollami |
| 10,260,342 | B1 | 4/2019 | Sollami |
| 10,323,515 | B1 | 6/2019 | Sollami |
| 10,337,324 | B2 | 7/2019 | Sollami |
| 10,370,966 | B1 | 8/2019 | Sollami |
| 10,385,689 | B1 | 8/2019 | Sollami |
| 10,415,386 | B1 | 9/2019 | Sollami |
| 10,502,056 | B2 | 12/2019 | Sollami |
| 2002/0063467 | A1 | 5/2002 | Taitt |
| 2002/0074850 | A1 | 6/2002 | Montgomery, Jr. |
| 2002/0074851 | A1 | 6/2002 | Montgomery, Jr. |
| 2002/0109395 | A1 | 8/2002 | Sollami |
| 2002/0167216 | A1 | 11/2002 | Sollami |
| 2002/0192025 | A1 | 12/2002 | Johnson |
| 2003/0015907 | A1 | 1/2003 | Sollami |
| 2003/0047985 | A1 | 3/2003 | Stiffler |
| 2003/0052530 | A1 | 3/2003 | Sollami |
| 2003/0122414 | A1 | 7/2003 | Sollami |
| 2003/0209366 | A1 | 11/2003 | McAlvain |
| 2004/0004389 | A1 | 1/2004 | Latham |
| 2004/0174065 | A1 | 9/2004 | Sollami |
| 2005/0212345 | A1 | 9/2005 | Sleep et al. |
| 2006/0071538 | A1 | 4/2006 | Sollami |
| 2006/0186724 | A1 | 8/2006 | Stehney |
| 2006/0261663 | A1 | 11/2006 | Sollami |
| 2007/0013224 | A1 | 1/2007 | Stehney |
| 2007/0040442 | A1 | 2/2007 | Weaver |
| 2007/0052279 | A1 | 3/2007 | Sollami |
| 2007/0080575 | A1* | 4/2007 | Sollami ..... E21C 35/197 299/106 |
| 2008/0035386 | A1 | 2/2008 | Hall et al. |
| 2008/0036276 | A1 | 2/2008 | Hall et al. |
| 2008/0036283 | A1 | 2/2008 | Hall et al. |
| 2008/0100124 | A1 | 5/2008 | Hall et al. |
| 2008/0145686 | A1 | 6/2008 | Mirchandani |
| 2008/0164747 | A1 | 7/2008 | Weaver et al. |
| 2008/0284234 | A1 | 11/2008 | Hall et al. |
| 2009/0146491 | A1 | 6/2009 | Fader et al. |
| 2009/0160238 | A1 | 6/2009 | Hall et al. |
| 2009/0256413 | A1 | 10/2009 | Majagi |
| 2009/0261646 | A1 | 10/2009 | Ritchie et al. |
| 2010/0045094 | A1 | 2/2010 | Sollami |
| 2010/0244545 | A1 | 9/2010 | Hall |
| 2010/0253130 | A1 | 10/2010 | Sollami |
| 2010/0320003 | A1 | 12/2010 | Sollami |
| 2010/0320829 | A1 | 12/2010 | Sollami |
| 2011/0006588 | A1 | 1/2011 | Monyak et al. |
| 2011/0089747 | A1 | 4/2011 | Helsel |
| 2011/0175430 | A1 | 7/2011 | Heiderich et al. |
| 2011/0204703 | A1 | 8/2011 | Sollami |
| 2011/0254350 | A1 | 10/2011 | Hall |
| 2012/0001475 | A1 | 1/2012 | Dubay et al. |
| 2012/0027514 | A1 | 2/2012 | Hall |
| 2012/0056465 | A1 | 3/2012 | Gerer et al. |
| 2012/0068527 | A1 | 3/2012 | Erdmann |
| 2012/0104830 | A1 | 5/2012 | Monyak et al. |
| 2012/0181845 | A1 | 7/2012 | Sollami |
| 2012/0242136 | A1 | 9/2012 | Ojanen |
| 2012/0248663 | A1 | 10/2012 | Hall |
| 2012/0261977 | A1 | 10/2012 | Hall |
| 2012/0280559 | A1 | 11/2012 | Watson |
| 2012/0286559 | A1 | 11/2012 | Sollami |
| 2012/0319454 | A1 | 12/2012 | Swope |
| 2013/0169023 | A1 | 7/2013 | Monyak |
| 2013/0181501 | A1 | 7/2013 | Hall et al. |
| 2013/0199693 | A1 | 8/2013 | Tank et al. |
| 2013/0307316 | A1 | 11/2013 | Roetsch et al. |
| 2014/0035346 | A1 | 2/2014 | Fundakowski et al. |
| 2014/0110991 | A1 | 4/2014 | Sollami |
| 2014/0232172 | A1 | 8/2014 | Roth et al. |
| 2014/0262541 | A1 | 9/2014 | Parsana et al. |
| 2014/0326516 | A1 | 11/2014 | Haugvaldstad |
| 2015/0028656 | A1 | 1/2015 | Sollami |
| 2015/0035343 | A1 | 2/2015 | Ojanen |
| 2015/0137579 | A1 | 5/2015 | Lachmann et al. |
| 2015/0198040 | A1 | 7/2015 | Voitic et al. |
| 2015/0240634 | A1 | 8/2015 | Sollami |
| 2015/0285074 | A1 | 10/2015 | Sollami |
| 2015/0292325 | A1 | 10/2015 | Sollami |
| 2015/0300166 | A1 | 10/2015 | Ries et al. |
| 2015/0308488 | A1 | 10/2015 | Kahl |
| 2015/0315910 | A1 | 11/2015 | Sollami |
| 2015/0354285 | A1 | 12/2015 | Hall |
| 2016/0102550 | A1 | 4/2016 | Paros et al. |
| 2016/0194956 | A1 | 7/2016 | Sollami |
| 2016/0229084 | A1 | 8/2016 | Lehnert |
| 2016/0237818 | A1 | 8/2016 | Weber et al. |
| 2017/0089198 | A1 | 3/2017 | Sollami |
| 2017/0101867 | A1 | 4/2017 | Hall et al. |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 1218308 | 1/1971 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

BIT HOLDER WITH ENLARGED TIRE PORTION AND NARROWED BIT HOLDER BLOCK

CROSS-REFERENCE TO RELATED APPLICATION(S)

This application claims priority to and is a continuation of U.S. Non-provisional application Ser. No. 15/062,620, filed Mar. 7, 2016, to the extent allowed by law and the contents of which are incorporated herein by reference in their entireties.

TECHNICAL FIELD

This disclosure relates to bit assemblies for road milling, mining, and trenching equipment, and more particularly, to a bit holder having an enlarged tire portion.

BACKGROUND

Road milling, mining, and trenching equipment utilizes bits traditionally set in a bit assembly having a bit holder and a bit holder block. The bit is retained by the bit holder and the bit holder is retained in the bit holder block. A plurality of the bit assemblies are mounted on the outside of a rotatable drum in staggered positions, typically in a V-shaped or spiral configuration, in an effort to create the smoothest road milling. The combinations of bit assemblies have been utilized to remove material from the terra firma, such as degrading the surface of the earth, minerals, cement, concrete, macadam or asphalt pavement. Individual bits, bit holders, and bit holder blocks may wear down or break over time due to the harsh road degrading environment. Tungsten carbide and diamond or polycrystalline diamond coatings, which are much harder than steel, have been used to prolong the useful life of bits and bit holders. However, bit holder blocks are generally made of steel. As a result, particles removed from the terra firma may damage the bit holder block and require replacement long before the standard minimum lifetime required by the industry.

SUMMARY

This disclosure relates generally to bit assemblies for road milling, mining, and trenching equipment. One implementation of the teachings herein is a bit holder for mounting in a bore of a bit holder block that includes a forward body portion having a tire portion radially extending from an axis of the bit holder, a generally cylindrical hollow shank depending axially from the tire portion, the shank having a slot axially extending from a distal end of the shank toward the forward body portion, and the tire portion having an axial distance at least as great as an outer perimeter of the bore of the bit holder block.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Figure 2:
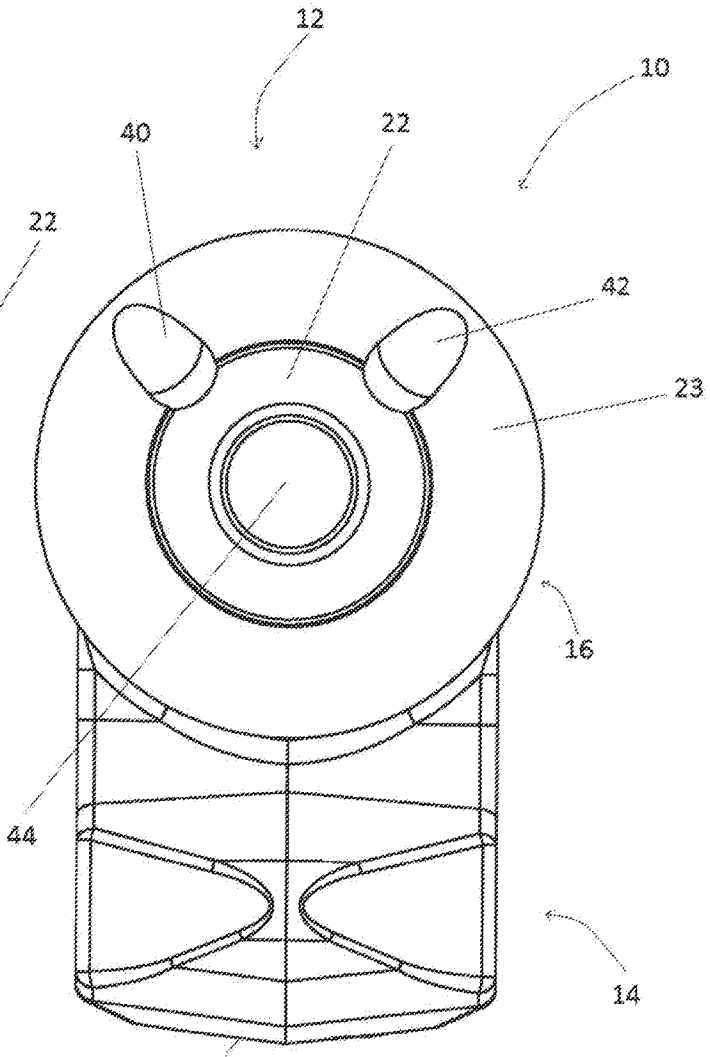
FIG. 2 is a detail front elevation view of the first embodiment of the bit assembly, without a bit, showing the bit holder and bit holder block.

Road milling, mining, and trenching equipment utilizes bits traditionally set in a bit assembly having a bit holder and a bit holder block. The bit is retained by the bit holder and the bit holder is retained in the bit holder block. A plurality of the bit assemblies are mounted on the outside of a rotatable drum in staggered positions, typically in a V-shaped or spiral configuration, in an effort to create the smoothest road milling. To provide a smoother surface, the size of the bit holder block can be reduced, such as by reducing the axial dimensions of the bit holder block, to allow the bit assemblies to be placed closer together. Such narrowed bit holder blocks allow closer center-to-center axial bit tip orientation with the V-shaped or spiral configurations, thereby resulting in a smoother road surface. One important aspect of the present disclosure is providing a bit holder block with narrowed dimensions to reduce the distance axial bit tip orientation.

Individual bits, bit holders, and bit holder blocks may wear down or break over time due to the harsh road degrading environment. Tungsten carbide and diamond or polycrystalline diamond coatings, which are much harder than steel, have been used to prolong the useful life of bits and bit holders. Bit holder blocks, herein after referred to as base blocks, are generally made of steel. Particles removed from the terra firma may damage the base block and require replacement long before the standard minimum lifetime required by the industry. Another important aspect of the present disclosure is providing a bit assembly that comprises a bit holder having dimensions at least that of the dimensions of the bit holder block to protect the base block and deflect particles removed from the terra firma away from the base block, thereby preventing premature damage to the base block.

Referring to FIGS. 1-8, a first embodiment of a bit assembly 10, without a bit, comprises a bit holder 12 and a base block 14. The bit holder 12 includes a bit holder body 16 and a shank 18 axially depending from the bottom of the bit holder body 16. The bit holder body 16 is generally annular in shape and comprises a generally cylindrical upper body portion 20 axially extending from a flat annular top surface 22. Subjacent the upper body portion 20 is a middle portion 23 that extends axially and radially outwardly to a radially extending generally cylindrical tire portion 24. The middle portion 23, shown in detail in FIG. 1, has an arcuate shape. In other embodiments, the middle portion 23 can have a frustoconical shape, a convex shape, or a concave shape.

Figure 1:
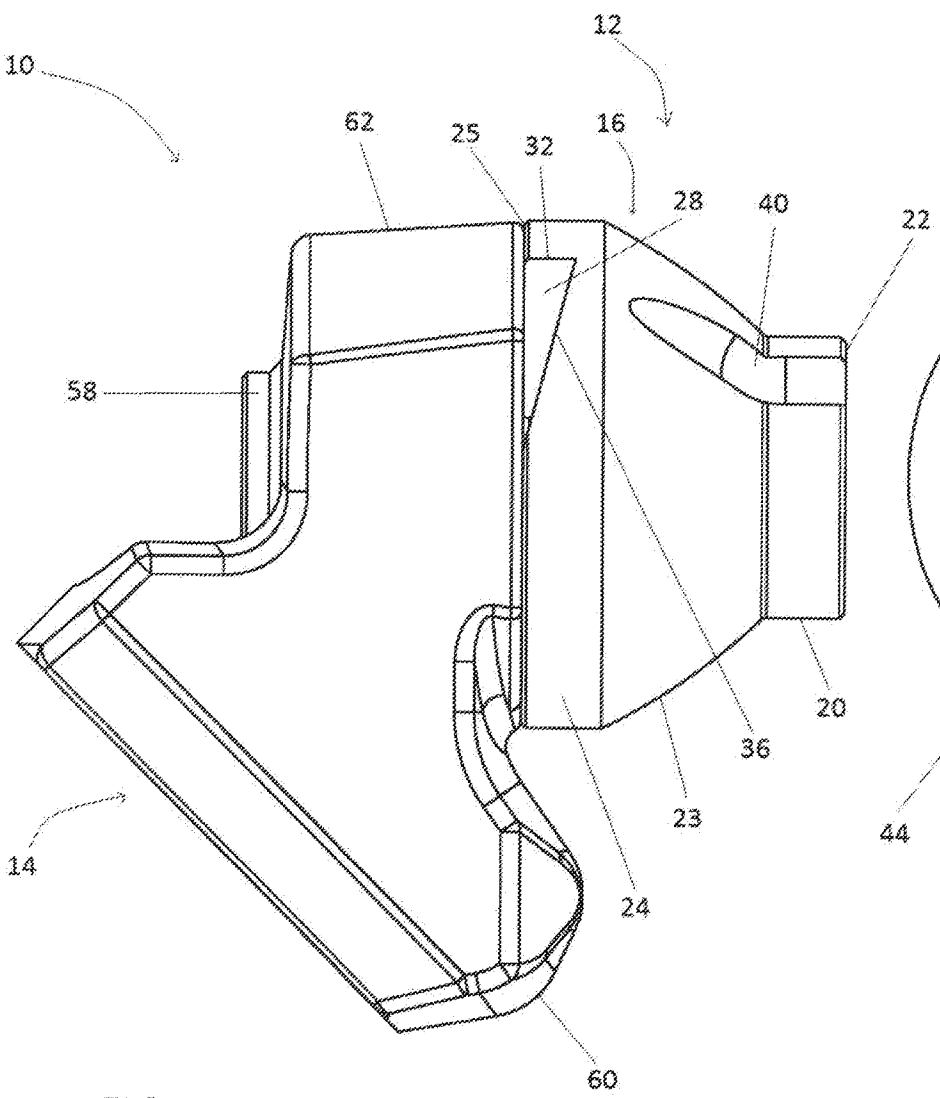
FIG. 1 is a detail side elevation view of a first embodiment of a bit assembly, without a bit, showing a bit holder and bit holder block.
Figure 6:
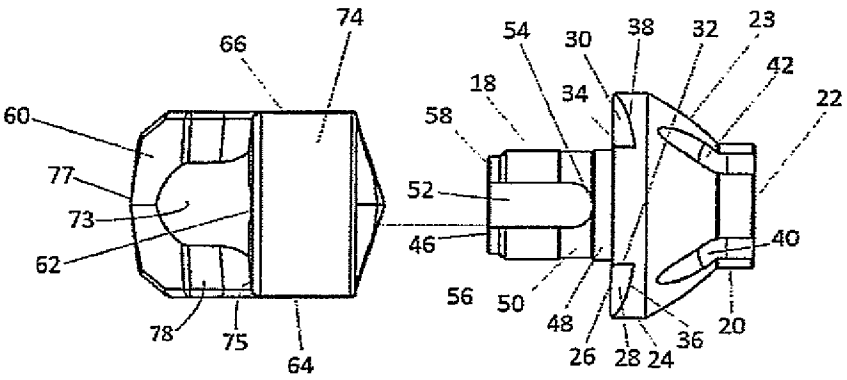
FIG. 6 is an exploded top elevation view of the first embodiment of the bit assembly, without a bit, showing the bit holder and bit holder block.
Figure 7:
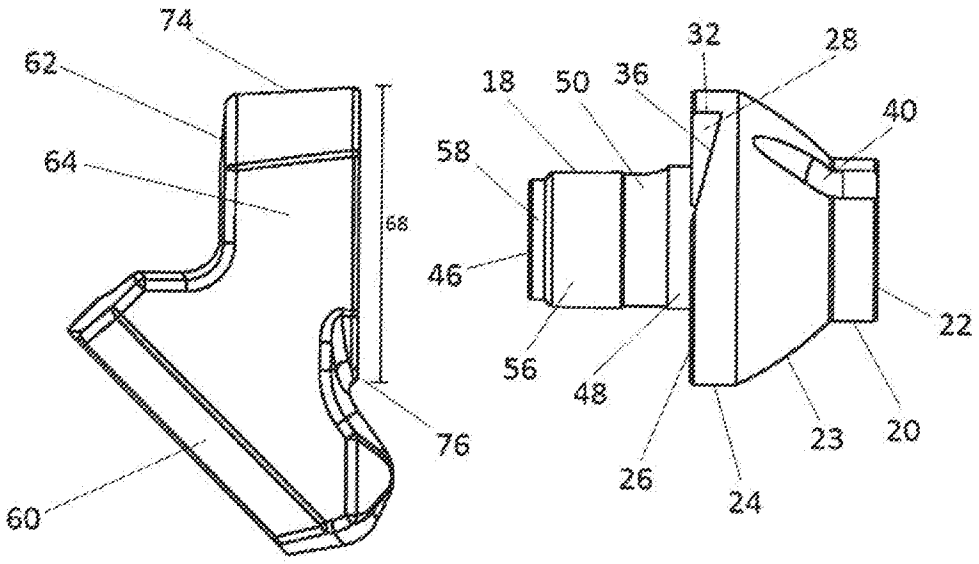
FIG. 7 is an exploded side elevation view of the first embodiment of the bit assembly, without a bit, showing the bit holder and bit holder block.

Adjacent the tire portion 24 is a tapered portion 25, shown in FIG. 1, that ends in a flange 26, such as a flat annular flange, shown in FIGS. 6 and 7, of the bit holder body 16. The tire portion 24 includes a pair of tapered cutouts 28, 30, or wedge-shaped undercuts, shown in FIGS. 1, 3, and 5-7, to provide access and leverage for a tool to extract the bit holder 12 from the base block 14. The tapered cutouts 28, 30 are formed into the tire portion 24 and extend from the flange 26 subjacent to the tire portion 24. The tapered cutouts 28, 30 include a pair of parallel flat vertical inner surfaces 32, 34, respectively, as shown in FIGS. 1, 3, and 5-7, and a pair of flat tapered top surfaces 36, 38, respectively, as shown in FIGS. 1, and 5-7. The outer edge of the flat tapered top surfaces 36, 38 is each arcuate in shape to follow the periphery of the tire portion 24. A pair of notches 40, 42, shown in FIGS. 2, 3, and 5-8, are formed into the bit holder body 16 and extend from the flat annular top surface 22 through the upper body portion 20 and the middle portion 23, terminating at a point within the middle portion 23. The notches 40, 42 provide access and leverage for a tool to extract, or knock out, a bit from the bit holder body 16.

Figure 8:
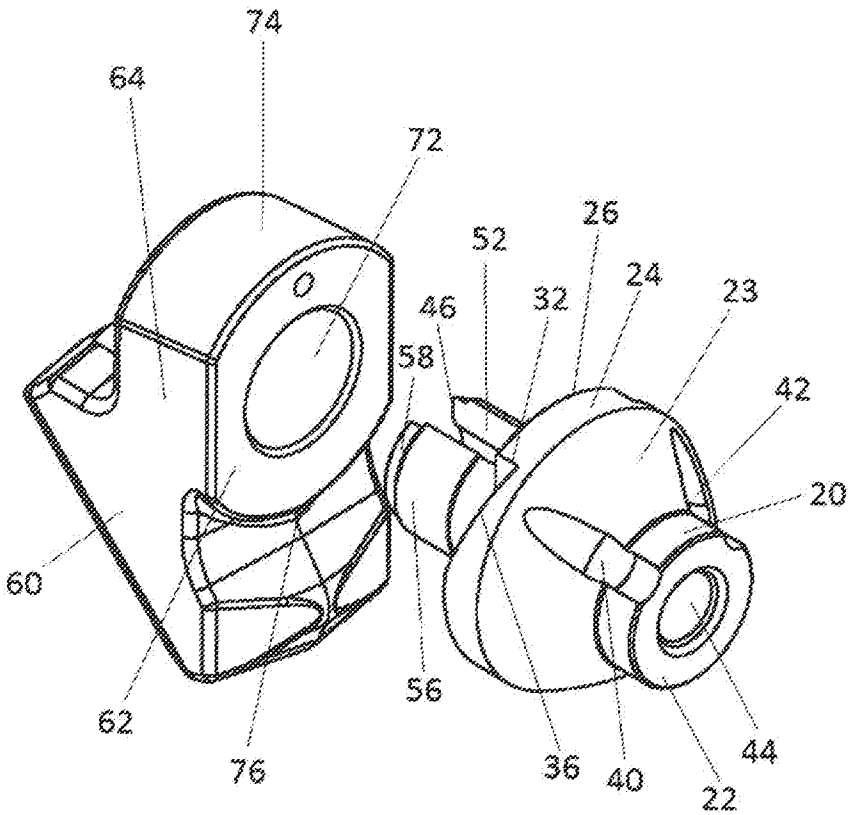
FIG. 8 is a ¾ front exploded perspective view of the first embodiment of the bit assembly, without a bit, showing the bit holder and bit holder block.
Figure 10:
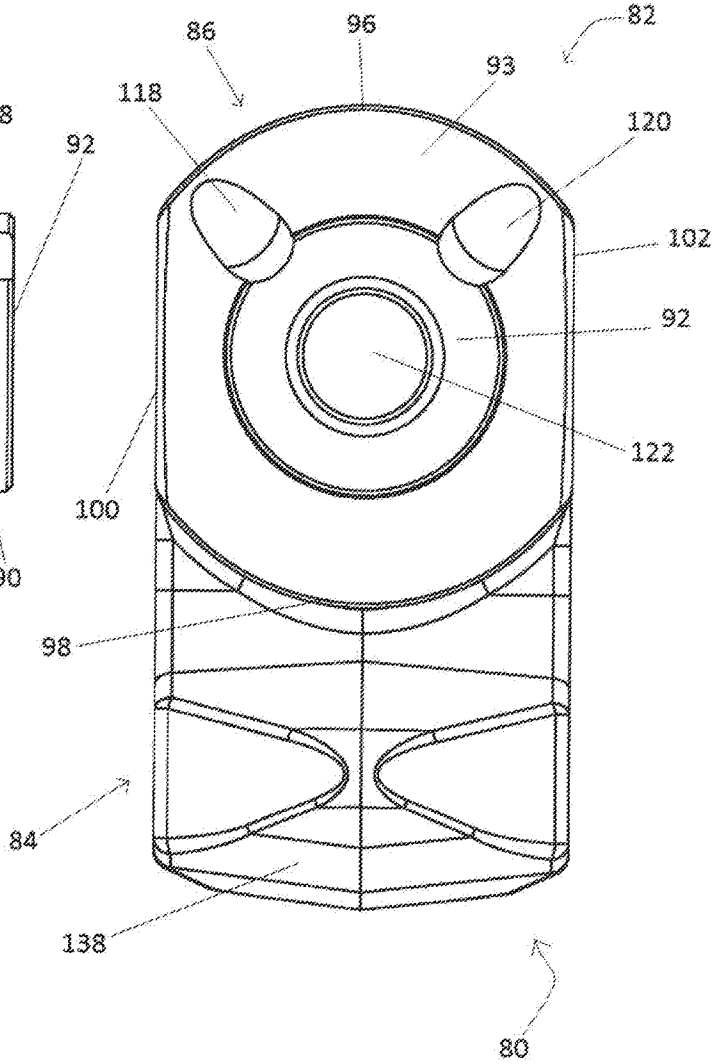
FIG. 10 is a detail front elevation view of the second embodiment of the bit assembly, without a bit, showing the bit holder and bit holder block.

The shank 18, shown in FIGS. 6-8, axially depends from the flange 26 of the bit holder body 16. The bit holder body 16 and the shank 18 are axially aligned about a bit holder bore 44, shown in FIGS. 2 and 8, that extends from the flat annular top surface 22 of the bit holder body 16 to a distal end 46 of the shank 18. The shank 18 comprises an increased diameter top segment 48 that axially extends from the flange 26. A decreased diameter mediate segment 50 is subjacent to the increased diameter top segment 48. The decreased diameter mediate segment 50 can have a generally cylindrical shape, an arcuate shape, or can be tapered towards the increased diameter top segment 48 or towards the distal end 46 of the shank 18. A slot 52, shown in FIGS. 6 and 8, extends from an upper termination 54 in the decreased diameter mediate segment 50 to the distal end 46 of the shank 18. Subjacent the decreased diameter mediate segment 50 is a lower segment 56 that axially extends to a decreased diameter distal segment 58. The decreased diameter distal segment 58 axially extends from the lower segment 56 to the distal end 46 of the shank 18 and is generally C-shaped when viewed from the distal end 46.

Figure 3:
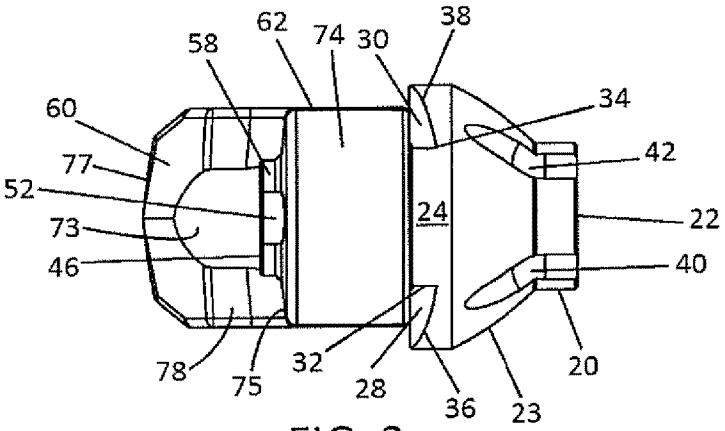
FIG. 3 is a top elevation view of the first embodiment of the bit assembly, without a bit, showing the bit holder and bit holder block.
Figure 5:
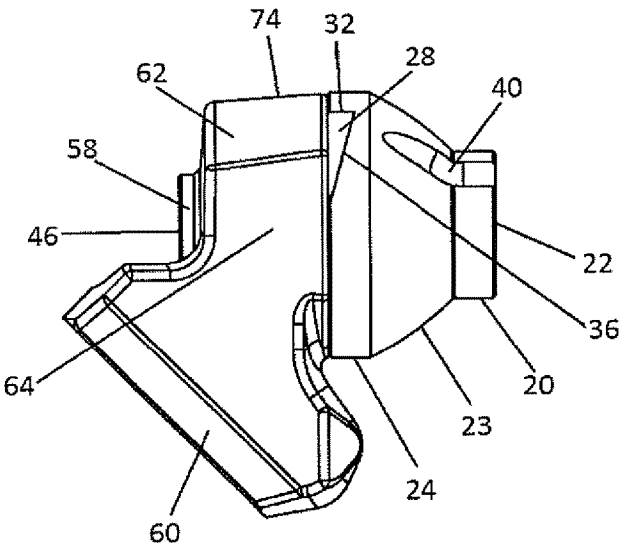
FIG. 5 is a side elevation view of the first embodiment of the bit assembly, without a bit, showing the bit holder and bit holder block.
Figure 4:
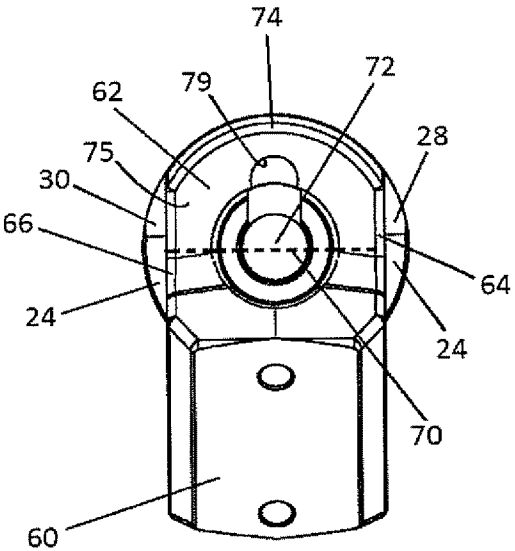
FIG. 4 is a rear elevation view of the first embodiment of the bit assembly, without a bit, showing the bit holder and bit holder block.

The base block 14 comprises a base 60 and a shortened front end 62. The base 60 can be flat or slightly concave to fit a drum or additional mounting plates on which a plurality of base blocks can be mounted. The shortened front end 62 includes a base block bore 72, shown in FIGS. 4 and 8, that is symmetrical with the shank 18 along a centerline. The shortened front end 62 and the base block bore 72, in this embodiment, are shortened to approximately 1.5 inches in length by removing material from the rear face 75 (FIGS. 3, 4, and 6) of the shortened front end 62. The base block 14 includes a semi-circular slot 79 (FIG. 4) that extends inwardly from the rear face 75 of the shortened front end 62. The slot 79 is enclosed within the wall of the shortened front end 62. As shown in FIGS. 3 and 6, a portion 78 of the base block 14 includes an arcuate segment 73 that axially extends from the rear face 75 of the shortened front end 62 to a location adjacent a rear 77 of the base block 14. The arcuate segment 73, in this exemplary implementation, has a reduced radius from the radius of the bore 72, as shown in FIGS. 3 and 6, and extends to a location short of a bottom of the rear 77 of the base 60. The shortened front end 62 also includes a pair of flat vertical sides 64, 66, shown in FIGS. 4, 5, 6 and 8, that extend to the base 60. The flat vertical sides 64, 66 reduce the dimensions of the base block 14 and allow bit assemblies to be positioned in closer center-to-center axial bit tip orientation in order to degrade the road to a smoother surface. In this exemplary implementation, the width of the item, such as the width of the shortened front end 62, is the horizontal distance 70 between the flat vertical sides 64, 66 of the shortened front end 62. The vertical distance 68, shown in FIG. 7, between a top portion 74 and a bottom portion 76 of the shortened front end 62 is greater than the horizontal distance 70, shown in FIG. 4, between the flat vertical sides 64, 66 of the shortened front end 62. The diameter of the tire portion 24 of the bit holder body 16 is greater than the width of the shortened front end 62, or the horizontal distance 70, and is equal to or greater than the vertical distance 68 of the shortened front end 62 of the base block 14.

When assembled, slot 52 allows the shank 18 to radially compress when inserted into the base block bore 72 of the shortened front end 62 forming an interference fit between the shank 18 and the base block bore 72. The force between the diametrically contracted shank 18 and the base block bore 72 maintains and retains the bit holder 12 in the base block 14. The bit holder 12 and the base block 14 are assembled together to form the bit assembly 10. The bit holder 12, including the bit holder body 16, shank 18, and bit holder bore 44, and the base block 14, including the base 60, shortened front end 62, and base block bore 72, are all axially aligned when assembled together to form the bit assembly 10. The bit holder body 16 covers the entirety of the shortened front end 62, thereby deflecting material removed from the terra firma and protecting the base block 14 from damage.

Referring to FIGS. 9-16, a second embodiment of a bit assembly 80, without a bit, comprises a bit holder 82 and a base block 84. The bit holder 82 includes a bit holder body 86 and a shank 88 axially depending from the bottom of the bit holder body 86. The bit holder body 86 is generally annular in shape and comprises a generally cylindrical upper body portion 90 axially extending from a flat annular top surface 92. Subjacent the upper body portion 90 is a middle portion 93 that extends axially and radially outwardly to a radially extending generally cylindrical tire portion 94. The middle portion 93, shown in detail in FIG. 1, has an arcuate shape. In other embodiments, the middle portion 93 can have a frustoconical shape, a convex shape, or a concave shape. The middle portion 93 and tire portion 94 share a curved top surface 96 and a curved bottom surface 98, shown in FIGS. 10, 12, and 16. The middle portion 93 and tire portion 94 also share a pair of vertical sides 100, 102, shown in FIGS. 10 and 16. In this embodiment, the vertical sides 100, 102 can have concave portions 101, 103, respectively, that curve radially inwardly, as shown in FIGS. 9, 13, and 15-16. However, in other embodiments, vertical sides 100, 102 can be flat.

Figure 9:
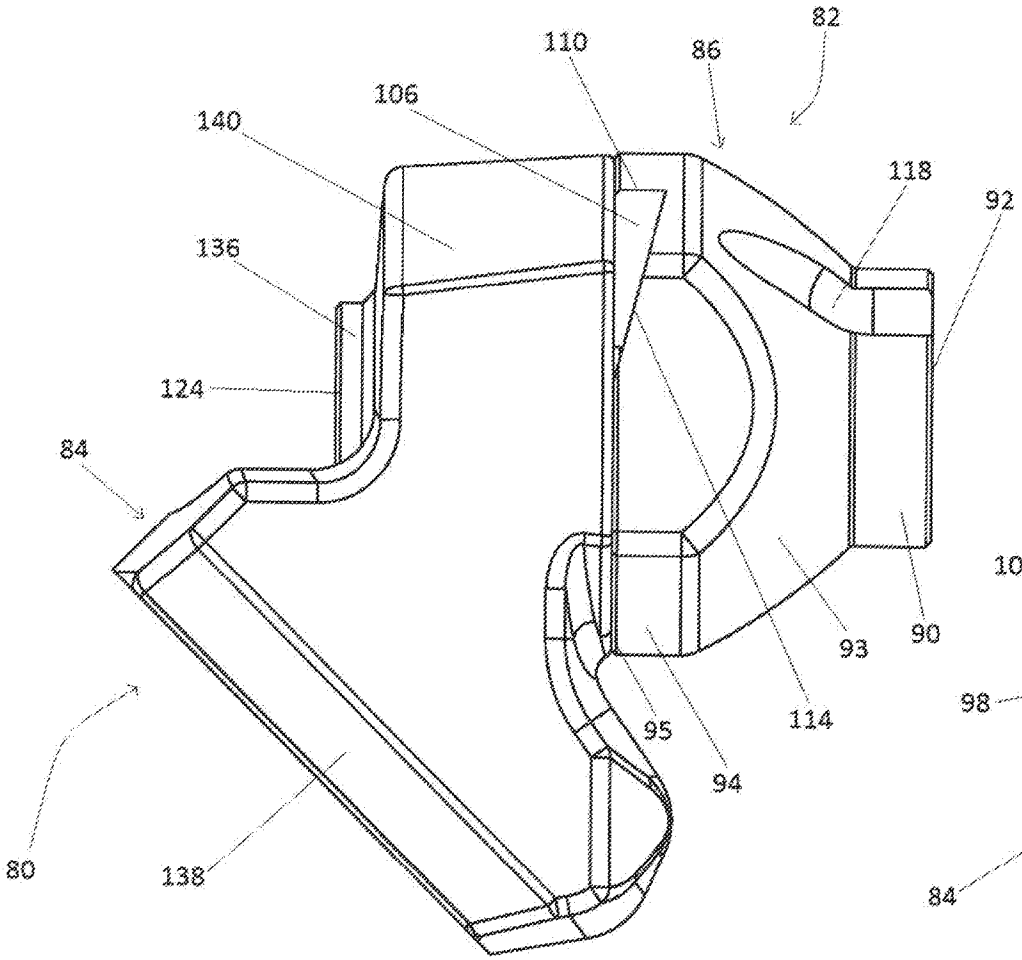
FIG. 9 is a detail side elevation view of a second embodiment of a bit assembly, without a bit, showing a bit holder and bit holder block.
Figure 14:
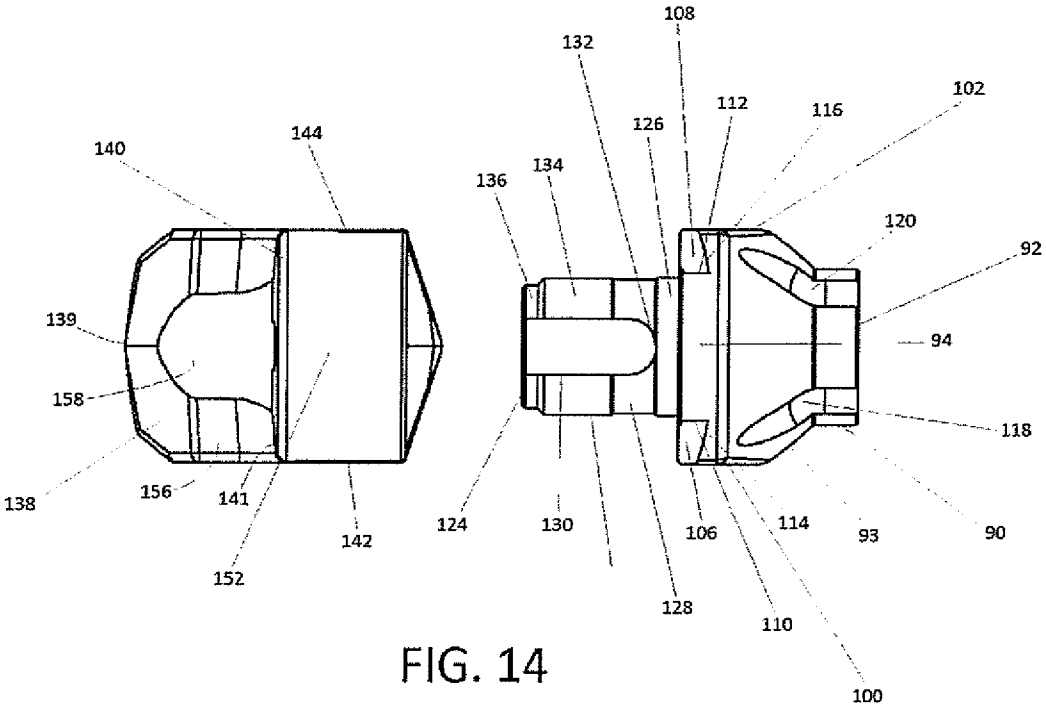
FIG. 14 is an exploded top elevation view of the second embodiment of the bit assembly, without a bit, showing the bit holder and bit holder block.
Figure 15:
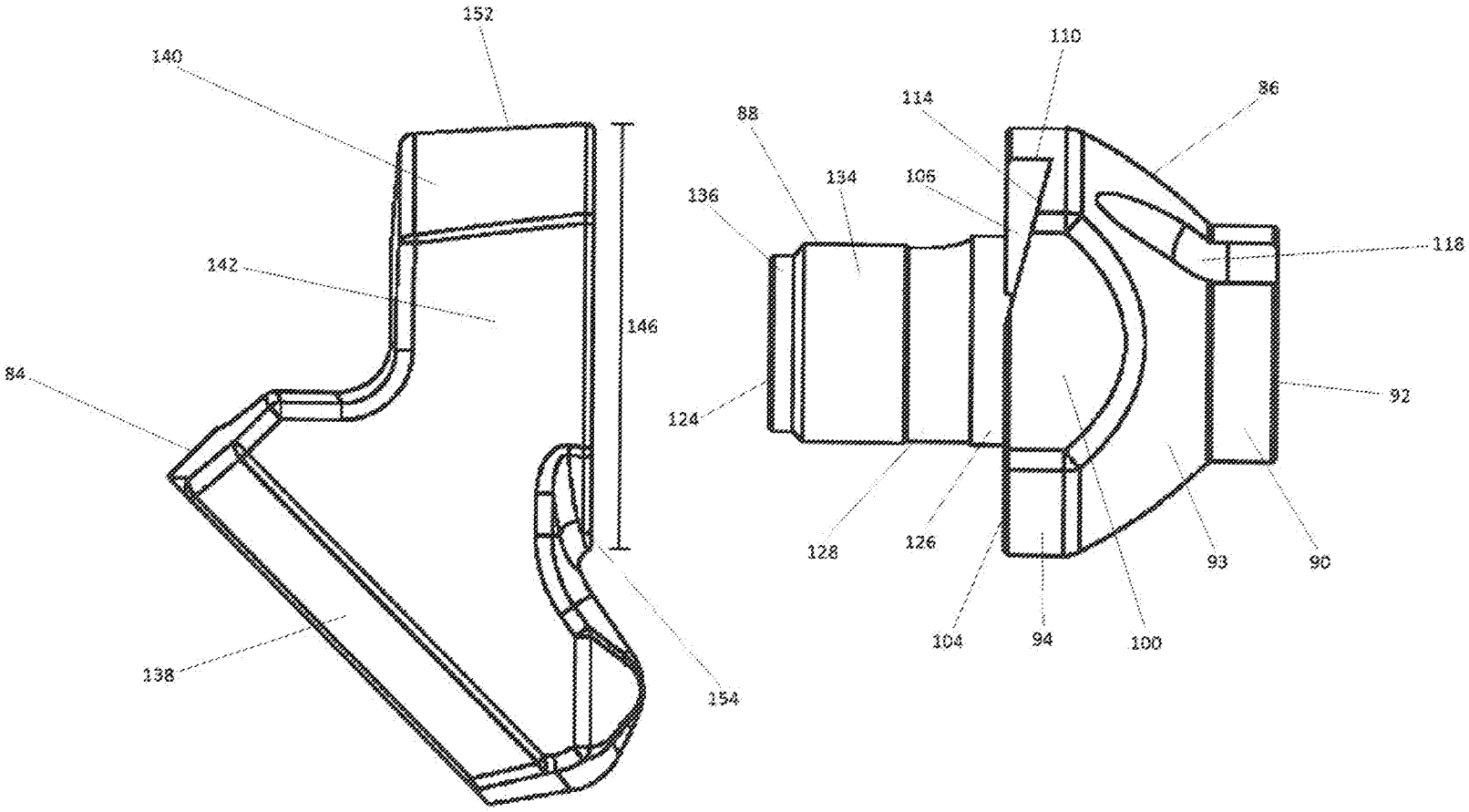
FIG. 15 is an exploded side elevation view of the second embodiment of the bit assembly, without a bit, showing the bit holder and bit holder block.

Adjacent the tire portion 94 is a tapered portion 95, shown in FIG. 9, that ends in a flange 104, such as a flat annular flange, shown in FIG. 15, of the bit holder body 86. The tire portion 94 includes a pair of tapered cutouts 106, 108, or wedge-shaped undercuts, shown in FIGS. 9, 11, and 13-15, to provide access and leverage for a tool to extract the bit holder 82 from the base block 84. The tapered cutouts 106, 108 are formed into the tire portion 94 and extend from a flange 104 subjacent to the tire portion 94. The tapered cutouts 106, 108 include a pair of parallel flat vertical inner surfaces 110, 112, respectively, as shown in FIGS. 9, 11, and 13-15, and a pair of flat tapered top surfaces 114, 116, respectively, as shown in FIGS. 9, and 13-15. The outer edge of the flat tapered top surfaces 114, 116 is each arcuate in shape to follow the periphery of the tire portion 94. A pair of notches 118, 120, shown in FIGS. 10, 11, and 13-16, are formed into the bit holder body 86 and extend from the flat annular top surface 92 through the upper body portion 90 and the middle portion 83, terminating at a point within the middle portion 83. The notches 118, 120 provide access and leverage for a tool to extract, or knock out, a bit from the bit holder body 86.

Figure 16:
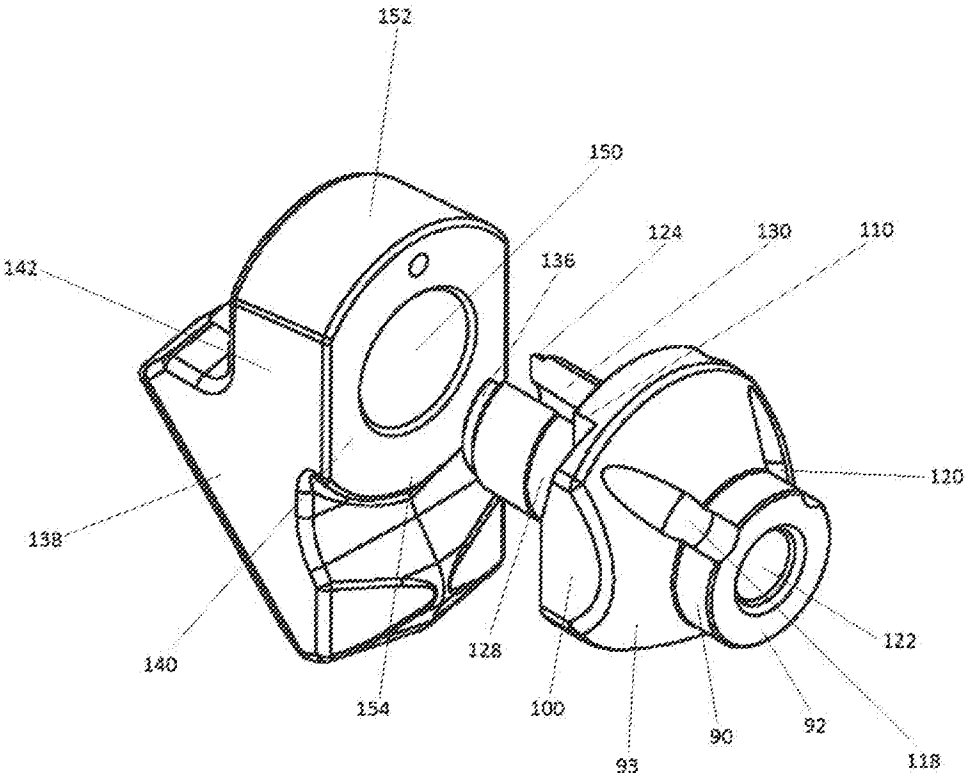
FIG. 16 is a ¾ front exploded perspective view of the second embodiment of the bit assembly, without a bit, showing the bit holder and bit holder block.

The shank 88, shown in FIGS. 14-16, axially depends from the flange 104 of the bit holder body 86. The bit holder body 86 and the shank 88 are axially aligned about a bit holder bore 122, shown in FIGS. 10 and 16, that extends from the flat annular top surface 92 of the bit holder body 86 to a distal end 124 of the shank 88. The shank 88 comprises an increased diameter top segment 126 that axially extends from the flange 104. A decreased diameter mediate segment 128 is subjacent to the increased diameter top segment 126. The decreased diameter mediate segment 128 can have a generally cylindrical shape, an arcuate shape, or can be tapered towards the increased diameter top segment 126 or towards the distal end 124 of the shank 88. A slot 130, shown in FIGS. 14 and 16, extends from an upper termination 132 in the decreased diameter mediate segment 128 to the distal end 124 of the shank 88. Subjacent the decreased diameter mediate segment 128 is a lower segment 134 that axially extends to a decreased diameter distal segment 136. The decreased diameter distal segment 136 axially extends from the lower segment 134 to the distal end 124 of the shank 88 and is generally C-shaped when viewed from the distal end 124.

Figure 11:
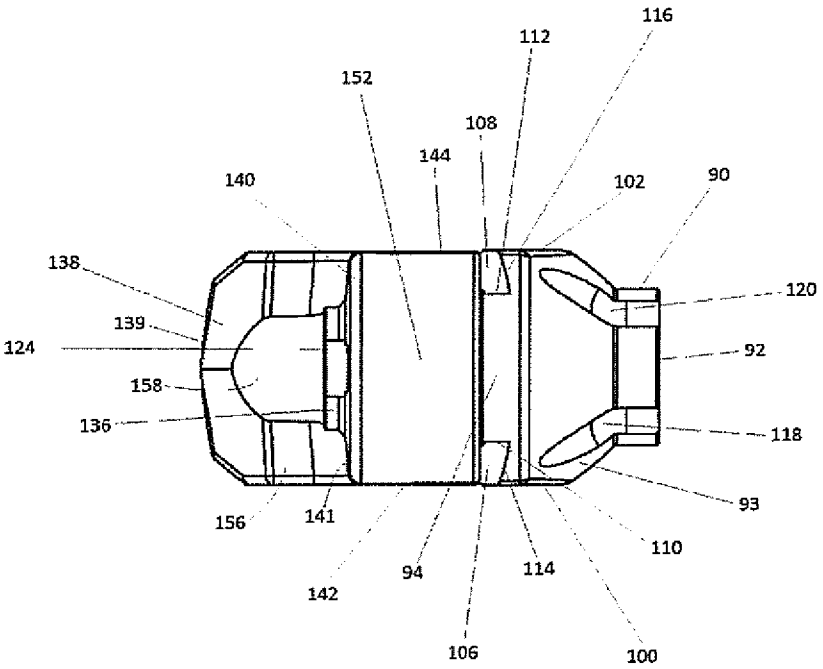
FIG. 11 is a top elevation view of the second embodiment of the bit assembly, without a bit, showing the bit holder and bit holder block.
Figure 13:
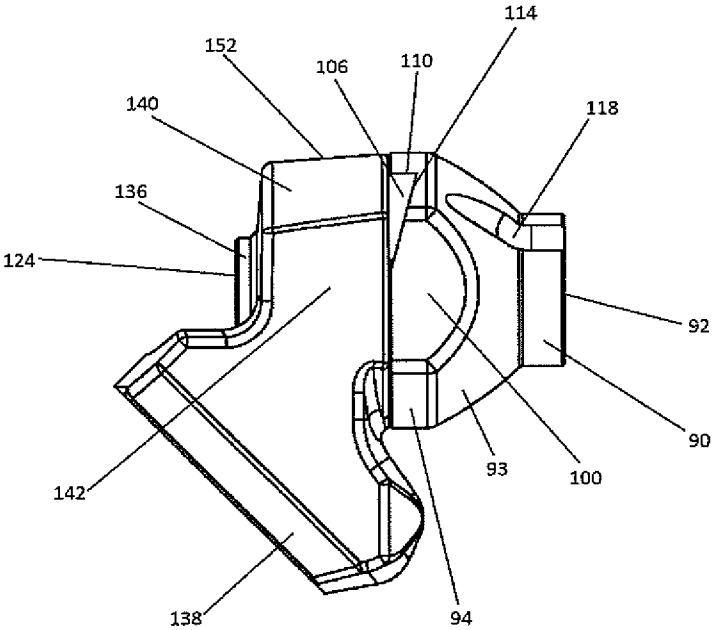
FIG. 13 is a side elevation view of the second embodiment of the bit assembly, without a bit, showing the bit holder and bit holder block.
Figure 12:
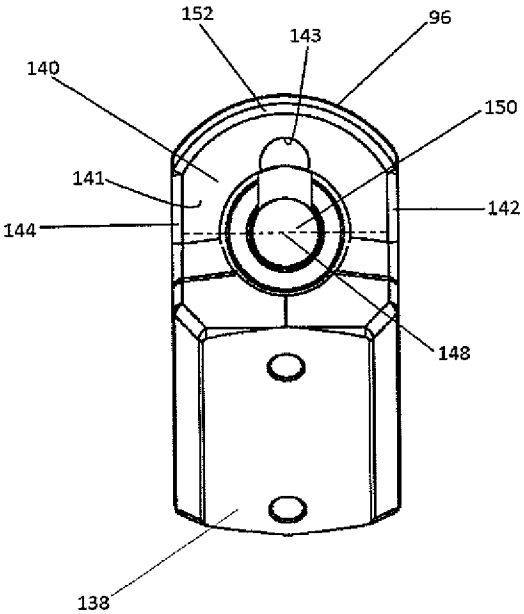
FIG. 12 is a rear elevation view of the second embodiment of the bit assembly, without a bit, showing the bit holder and bit holder block.

The base block 84 comprises a base 138 and a shortened front end 140. The base 138 can be flat or slightly concave to fit a drum or additional mounting plates on which a plurality of base blocks can be mounted. The shortened front end 140 includes a base block bore 150, shown in FIGS. 12 and 16, that is symmetrical with the shank 88 along a centerline. The shortened front end 140 and the base block bore 150, in this embodiment, are shortened to approximately 1.5 inches in length by removing material from the rear face 141 (FIGS. 11, 12, and 14) of the shortened front end 140. The base block 84 includes a semi-circular slot 143 (FIG. 12) that extends inwardly from the rear face 141 of the shortened front end 140. The slot 143 is enclosed within the wall of the shortened front end 140. As shown in FIGS. 11 and 14, a portion 156 of the base block 84 includes an arcuate segment 158 that extends from the rear face 141 of the shortened front end 140 to a location adjacent a rear 139 of the base block 84. The arcuate segment 158, in this exemplary implementation, has a reduced radius from the radius of the bore 150, as shown in FIGS. 11 and 14, and extends to a location short of a bottom of the rear 139 of the base 138. The shortened front end 140 also includes a pair of flat vertical sides 142, 144, shown in FIGS. 11, 12, 14 and 16, that extend to the base 138. The flat vertical sides 142, 144 reduce the dimensions of the base block 14 and allow bit assemblies to be positioned in closer center-to-center axial bit tip orientation in order to degrade the road to a smoother surface. In this exemplary implementation, the width of the item, such as the width of the shortened front end 140, is the horizontal distance 148 between the flat vertical sides 142, 144 of the shortened front end 140. The vertical distance 146, shown in FIG. 15, between a top portion 152 and a bottom portion 154 of the shortened front end 140 is greater than the horizontal distance 148, shown in FIG. 12, between the flat vertical sides 142, 144 of the shortened front end 140. The distance between vertical side 100 and vertical side 102 of the tire portion 94 of the bit holder body 86 is at least equal to the horizontal distance 148 of the shortened front end 140 of the base block 84. The distance between the curved top surface 96 and the curved bottom surface 98 of the tire portion 94 of the bit holder body 86 is equal to or greater than the vertical distance 146 of the shortened front end 140 of the base block 84.

When assembled, slot 130 allows the shank 88 to radially compress when inserted into the base block bore 150 of the shortened front end 140 forming an interference fit between the shank 88 and the base block bore 150. The force between the diametrically contracted shank 88 and the base block bore 150 maintains and retains the bit holder 82 in the base block 84. The bit holder 82 and the base block 84 are assembled together to form the bit assembly 80. The bit holder 82, including the bit holder body 86, shank 88, and bit holder bore 122, and the base block 84, including the base 138, shortened front end 140, and base block bore 150, are all axially aligned when assembled together to form the bit assembly 80. The bit holder body 86 covers the entirety of the shortened front end 140, thereby deflecting material removed from the terra firma and protecting the base block 84 from damage.

Referring to FIGS. 17-26, a third embodiment of a bit assembly 160, without a bit, comprises a bit holder 162 and a base block 164. The bit holder 162 includes a bit holder body 166, a shank 168, and a bit holder bore 202 axially depending from the bottom of the bit holder body 166. The bit holder body 166 is generally annular in shape and comprises a generally cylindrical upper body portion 170 axially extending from a flat annular top surface 172. Subjacent the upper body portion 170 is a middle portion 173 that extends axially and radially outwardly to a radially extending generally cylindrical tire portion 174. The middle portion 173, shown in detail in FIG. 17, has an arcuate shape. In other embodiments, the middle portion 173 can have a frustoconical shape, a convex shape, or a concave shape.

Figure 18:
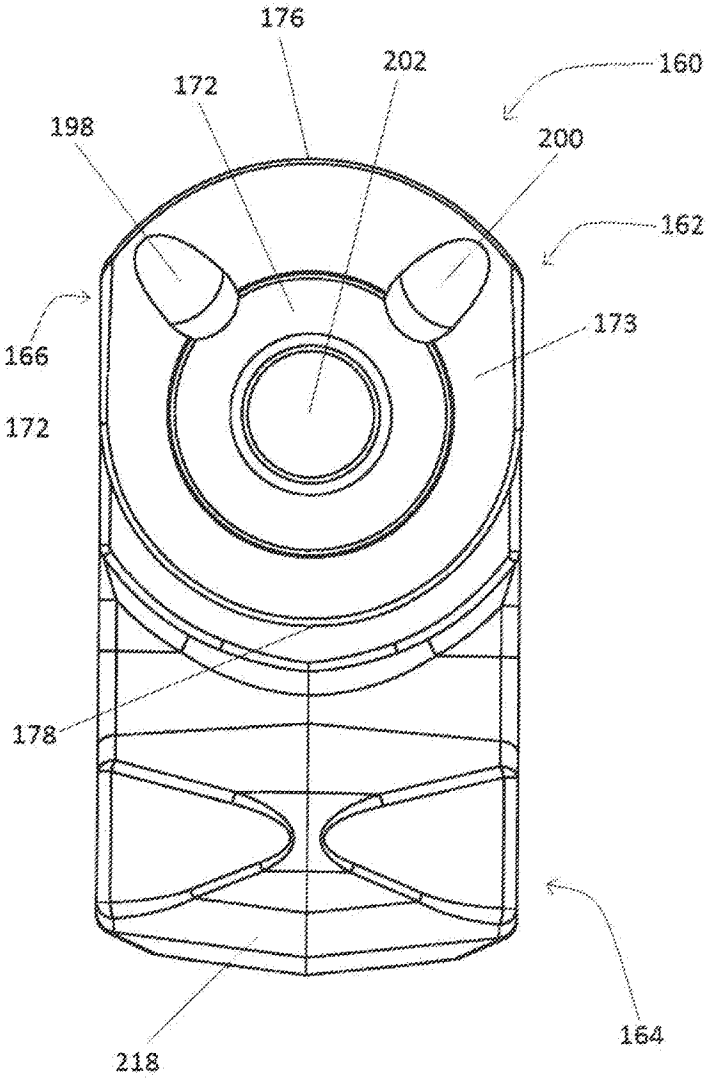
FIG. 18 is a detail front elevation view of the third embodiment of the bit assembly, without a bit, showing the bit holder and bit holder block.
Figure 19:
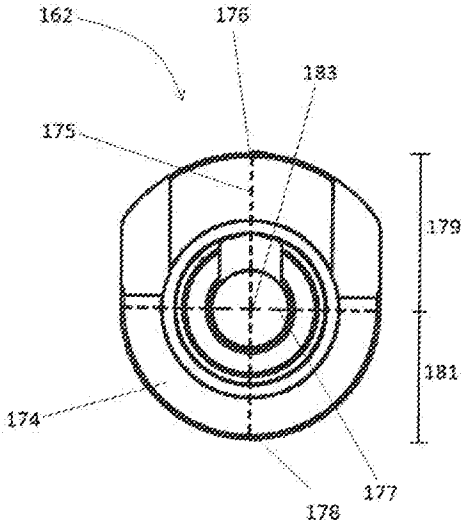
FIG. 19 is a front elevation view of the bit holder of the third embodiment of the bit assembly.

The middle portion 173 and tire portion 174 share a curved top surface 176 and a curved bottom surface 178, shown in FIGS. 18 and 19. The middle portion 173 and tire portion 174 also share a pair of vertical sides 180, 182, shown in FIGS. 18 and 19. The vertical sides 180, 182 meet the curved top surface 176 at an angle, while the vertical sides 180, 182 curve into the curved bottom surface 178, providing a bit holder body 166 that is generally U-shaped when viewed from the flat annular top surface 172. The vertical sides 180, 182 can be flat or can include a reverse taper towards the curved top surface 176 of the bit holder body 166.

Referring to FIG. 19, the vertical diameter 175, between the curved top surface 176 and the curved bottom surface 178, of the tire portion 174 is greater than the horizontal diameter 177, between vertical side 180 and vertical side 182, of the tire portion 174, shown in FIG. 19. The vertical diameter 175 of the tire portion 174 comprises a top vertical radius 179 greater than a bottom vertical radius 181, measured from an axis 183 of the bit holder bore 202. The top vertical radius 179 is measured from the axis 183 to the curved top surface 176 and the bottom vertical radius 181 is measured from the axis 183 to the curved bottom surface 178.

Figure 17:
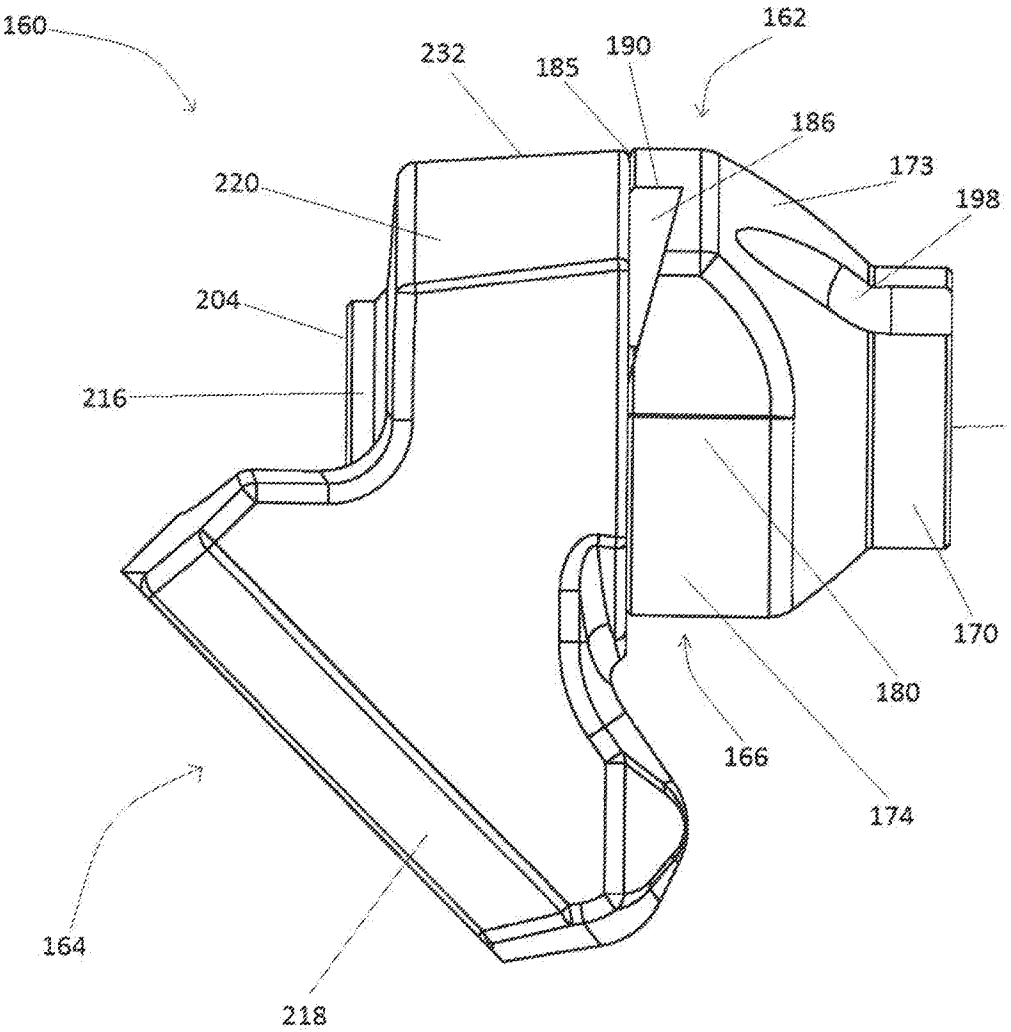
FIG. 17 is a detail side elevation view of a third embodiment of a bit assembly, without a bit, showing a bit holder and bit holder block.
Figure 20:
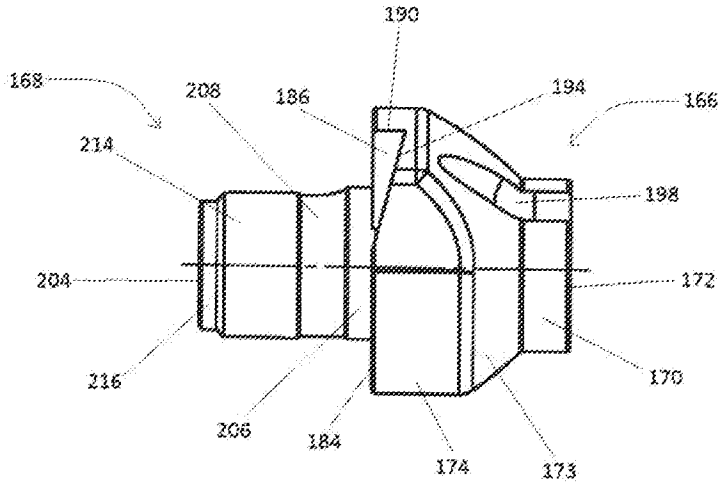
FIG. 20 is a side elevation view of the bit holder of the third embodiment of the bit assembly.
Figure 24:
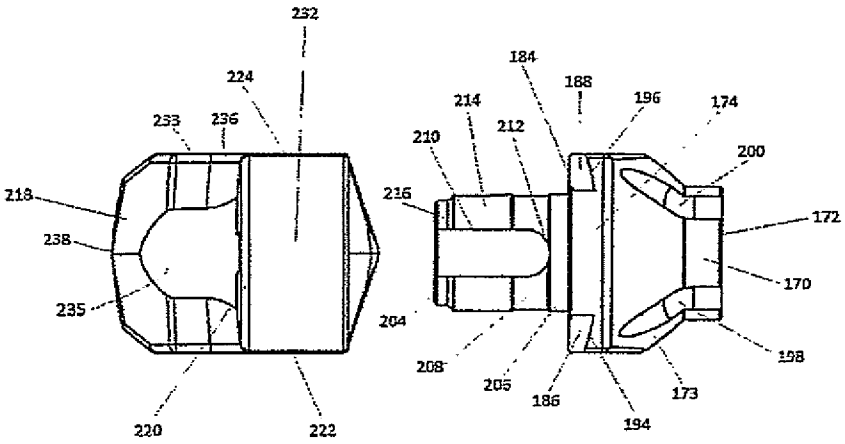
FIG. 24 is an exploded top elevation view of the third embodiment of the bit assembly, without a bit, showing the bit holder and bit holder block.
Figure 25:
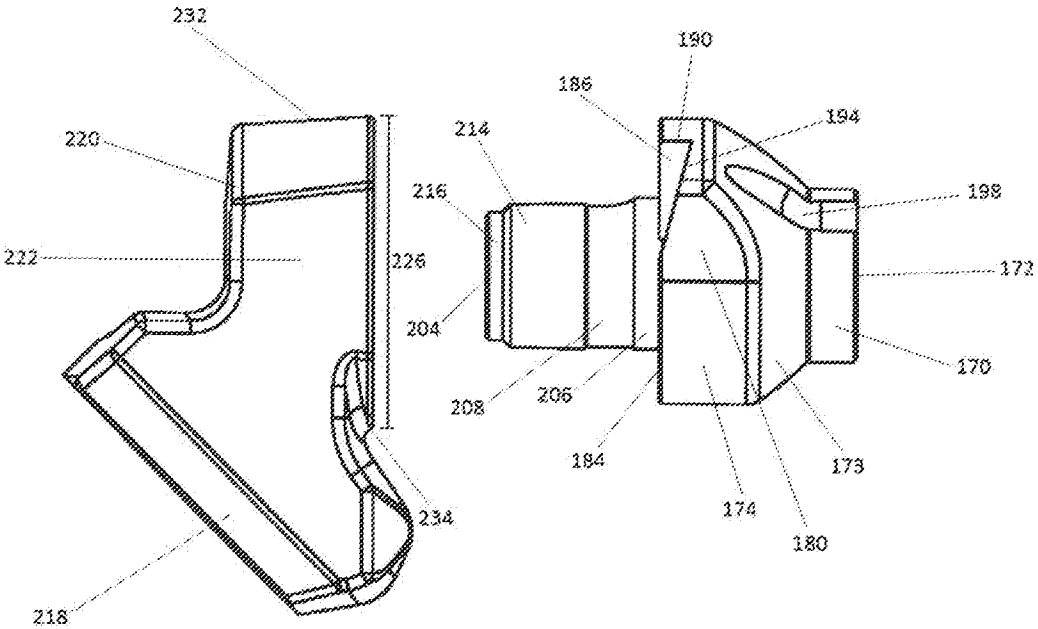
FIG. 25 is an exploded side elevation view of the third embodiment of the bit assembly, without a bit, showing the bit holder and bit holder block.
Figure 26:
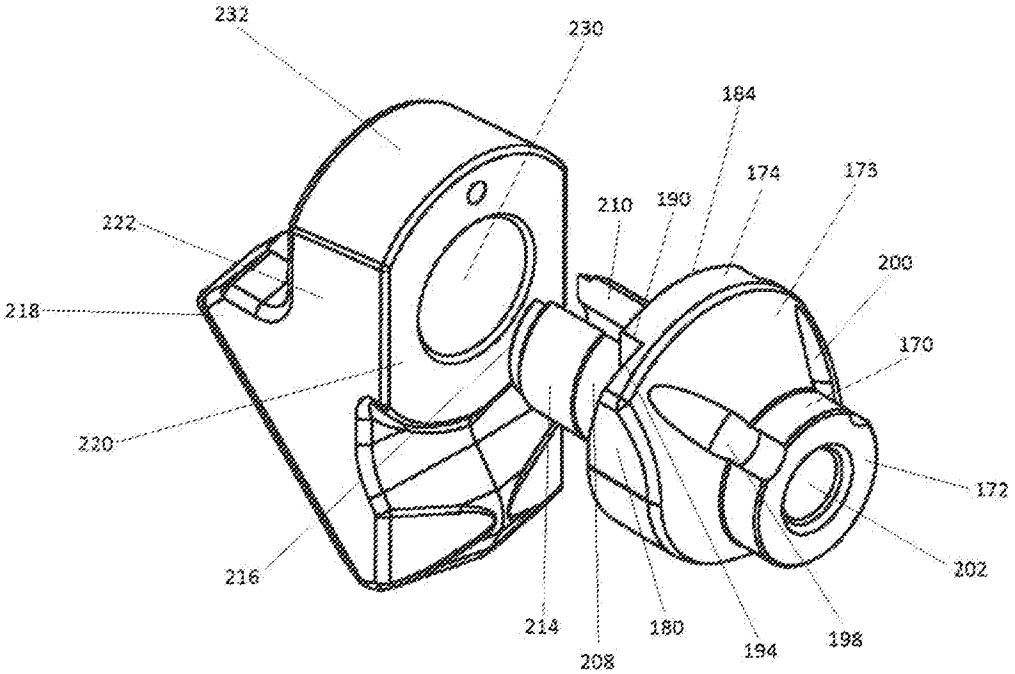
FIG. 26 is a ¾ front exploded perspective view of the third embodiment of the bit assembly, without a bit, showing the bit holder and bit holder block.

Adjacent the tire portion 174 is a tapered portion 185, shown in FIG. 17, that ends in a flange 184, such as a flat annular flange, shown in FIGS. 24 and 25, of the bit holder body 166. The tire portion 174 includes a pair of tapered cutouts 186, 188, or wedge-shaped undercuts, shown in FIGS. 17, 20-21, and 23-26, to provide access and leverage for a tool to extract the bit holder 162 from the base block 164. The tapered cutouts 186, 188 are formed into the tire portion 174 and extend from a flange 184 subjacent to the tire portion 174. The tapered cutouts 186, 188 include a pair of parallel flat vertical inner surfaces 190, 192, respectively, as shown in FIGS. 17, 20-21, and 23-25, and a pair of flat tapered top surfaces 194, 196, respectively, as shown in FIGS. 17, 20, and 23-25. The outer edge of the flat tapered top surfaces 194, 196 is each arcuate in shape to follow the periphery of the tire portion 174. A pair of notches 198, 200, shown in FIGS. 18, 21, and 23-26, are formed into the bit holder body 166 and extend from the flat annular top surface 172 through the upper body portion 170 and the middle portion 173, terminating at a point within the middle portion 173. The notches 198, 200 provide access and leverage for a tool to extract, or knock out, a bit from the bit holder body 166.

The shank 168, shown in FIGS. 20 and 24-26, axially depends from the flange 184 of the bit holder body 166. The bit holder body 166 and the shank 168 are axially aligned about a bit holder bore 202, shown in FIGS. 1 and 26, that extends from the flat annular top surface 172 of the bit holder body 166 to a distal end 204 of the shank 168. The shank 168 comprises an increased diameter top segment 206 that axially extends from the flange 184. A decreased diameter mediate segment 208 is subjacent to the increased diameter top segment 206. The decreased diameter mediate segment 208 can have a generally cylindrical shape, an arcuate shape, or can be tapered towards the increased diameter top segment 206 or towards the distal end 204 of the shank 168. A slot 210, shown in FIGS. 24 and 26, extends from an upper termination 212 in the decreased diameter mediate segment 208 to the distal end 204 of the shank 168. Subjacent the decreased diameter mediate segment 208 is a lower segment 214 that axially extends to a decreased diameter distal segment 216. The decreased diameter distal segment 216 axially extends from the lower segment 214 to the distal end 204 of the shank 168 and is generally C-shaped when viewed from the distal end 204.

Figure 21:
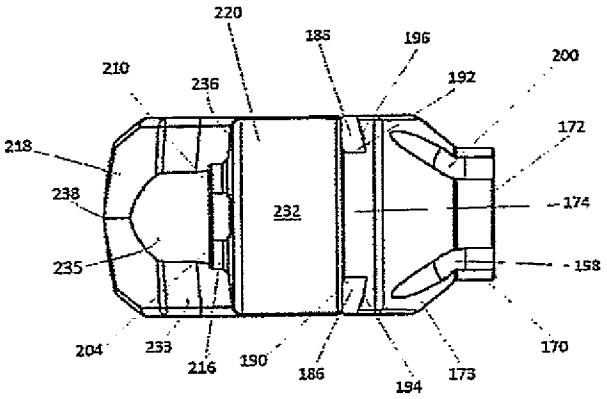
FIG. 21 is a top elevation view of the third embodiment of the bit assembly, without a bit, showing the bit holder and bit holder block.
Figure 23:
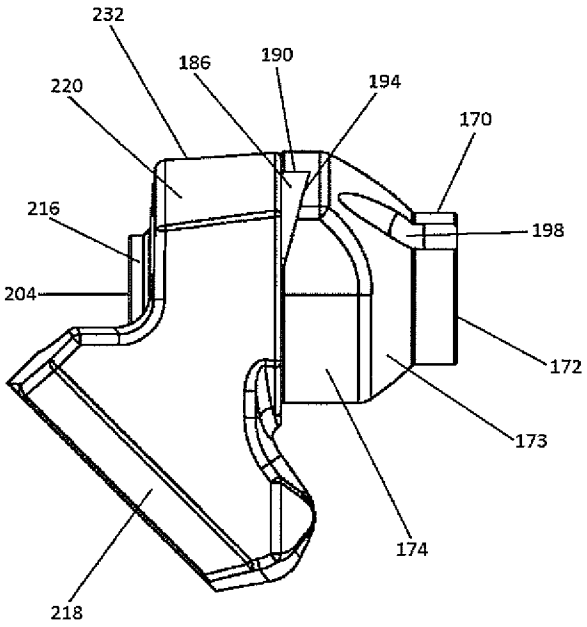
FIG. 23 is a side elevation view of the third embodiment of the bit assembly, without a bit, showing the bit holder and bit holder block.
Figure 22:
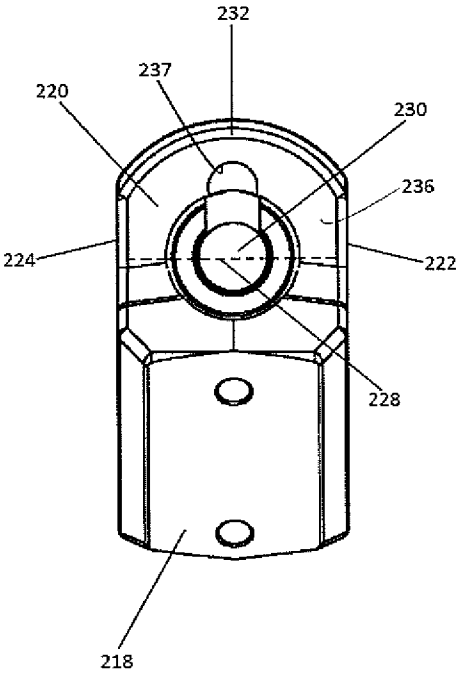
FIG. 22 is a rear elevation view of the third embodiment of the bit assembly, without a bit, showing the bit holder and bit holder block.

The base block 164 comprises a base 218 and a shortened front end 220. The base 218 can be flat or slightly concave to fit a drum or additional mounting plates on which a plurality of base blocks can be mounted. The shortened front end 220 includes a base block bore 230, shown in FIGS. 22 and 24, that is symmetrical with the shank 168 along a centerline. The shortened front end 220 and the base block bore 230, in this embodiment, are shortened to approximately 1.5 inches in length by removing material from the rear face 236 (FIGS. 21, 22, and 24) of the shortened front end 220. The base block 164 includes a semi-circular slot 237 (FIG. 22) that extends inwardly from the rear face 236 of the shortened front end 220. The slot 237 is enclosed within the wall of the shortened front end 220. As shown in FIGS. 21 and 24, a portion 233 of the base block 164 includes an arcuate segment 235 that extends from the rear face 236 of the shortened front end 220 to a location adjacent a rear 238 of the base block 164. The arcuate segment 235, in this exemplary implementation, has a reduced radius from the radius of the bore 230, as shown in FIGS. 21 and 24, and extends to a location short of a bottom of the rear 238 of the base 218. The shortened front end 220 also includes a pair of flat vertical sides 222, 224, shown in FIGS. 18, 21-22, 24 and 26, that extend to the base 218. The flat vertical sides 222, 224 reduce the dimensions of the base block 14 and allow bit assemblies to be positioned in closer center-to-center axial bit tip orientation in order to degrade the road to a smoother surface. In this exemplary implementation, the width of the item, such as the width of the shortened front end 220, is the horizontal distance 228 between the flat vertical sides 222, 224 of the shortened front end 220. The vertical distance 226, shown in FIG. 25, between a top portion 232 and a bottom portion 234 of the shortened front end 220 is greater than the horizontal distance 228, shown in FIG. 22, between the flat vertical sides 222, 224 of the shortened front end 220. The horizontal diameter 177 of the tire portion 174 of the bit holder body 166 is at least equal to the horizontal distance 228 of the shortened front end 220 of the base block 164. The vertical diameter 175 of the tire portion 174 is greater than the vertical distance 226 of the shortened front end 220 of the base block 164. The top vertical radius 179 of the tire portion 174 is greater than a radius of the shortened front end 220, measured from an axis 231 of the base block bore 230 to a top portion 232 of the shortened front end 220, such that the bit holder body 166 extends axially and radially past the top portion 232 of the shortened front end 220.

When assembled, slot 210 allows the shank 168 to radially compress when inserted into the base block bore 230 of the shortened front end 220 forming an interference fit between the shank 168 and the base block bore 230. The force between the diametrically contracted shank 168 and the base block bore 230 maintains and retains the bit holder 162 in the base block 164. The bit holder 162 and the base block 164 are assembled together to form the bit assembly 160. The bit holder 162, including the bit holder body 166, shank 168, and bit holder bore 202, and the base block 164, including the base 218, shortened front end 220, and base block bore 230, are all axially aligned when assembled together to form the bit assembly 160. The bit holder body 166 covers the entirety of the shortened front end 220, thereby deflecting material removed from the terra firma and protecting the base block 164 from damage.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A base block comprising:

a base;

a shortened front end extending from the base, the shortened front end comprising a pair of opposing flat sides and a bore extending from a front face at a forward end of the shortened front end to a rear wall at a distal end of the shortened front end; and a portion of the base comprising an arcuate segment axially extending past the rear wall at the distal end of the shortened front end to a location short of a bottom of a rear of the base, the arcuate segment comprising a reduced radius from a radius of the bore.

2. The base block of claim 1, wherein the pair of opposing flat sides each extend from adjacent a top portion of the shortened front end to the base.

3. The base block of claim 1, wherein the pair of opposing flat sides define a horizontal distance through a central axis of the bore.

4. The base block of claim 3, wherein the shortened front end comprises a top portion and a bottom portion that define a vertical distance, the vertical distance greater than the horizontal distance.

5. The base block of claim 1, the shortened front end and the bore comprising a length of approximately 1.5 inches.

6. A base block comprising:

a base;

a shortened front end extending from the base, the shortened front end comprising a pair of opposing flat sides and a bore extending from a front face at a forward end of the shortened front end to a rear wall at a distal end of the shortened front end;

a portion of the base comprising an arcuate segment axially extending past the rear wall at the distal end of the shortened front end to a location short of a bottom of a rear of the base; and a semi-circular slot extending inwardly from the rear wall at the distal end of the shortened front end, the slot enclosed within an outer side wall of the shortened front end.

7. The base block of claim 6, the shortened front end and the bore comprising a length of approximately 1.5 inches.

* * * * *